US009394734B1

(12) United States Patent
Berger

(10) Patent No.: US 9,394,734 B1
(45) Date of Patent: Jul. 19, 2016

(54) HINGE ASSEMBLY WITH SELF LUBRICATED PIN WITH ROLLER ASSEMBLY

(71) Applicant: Joseph C. Berger, Hialeah Gardens, FL (US)

(72) Inventor: Joseph C. Berger, Hialeah Gardens, FL (US)

(73) Assignee: Stealth Hardware Solutions, Inc., Miami, FL (US)

( * ) Notice: Subject to any disclaimer, the term of this patent is extended or adjusted under 35 U.S.C. 154(b) by 0 days.

(21) Appl. No.: 14/869,535

(22) Filed: Sep. 29, 2015

(51) Int. Cl.
*E05D 11/02* (2006.01)
*E05D 3/02* (2006.01)
*E05D 5/14* (2006.01)

(52) U.S. Cl.
CPC *E05D 11/02* (2013.01); *E05D 3/02* (2013.01); *E05D 5/14* (2013.01); *Y10T 16/537* (2015.01)

(58) Field of Classification Search
CPC ..... E05D 3/02; E05D 5/14; E05D 11/02; Y10T 16/537; Y10T 16/55963; Y10T 16/5377; Y10T 16/558; E05Y 2900/106
USPC ..... 16/273, 275, 387, 390
See application file for complete search history.

(56) References Cited

U.S. PATENT DOCUMENTS 1,936,237 A * 11/1933 Johnson ..... E05D 15/165 16/104
3,499,183 A * 3/1970 Parsons ..... E05D 5/10 16/273
3,599,275 A * 8/1971 Granzow ..... E05D 5/10 16/275
3,921,225 A * 11/1975 Suska ..... E05D 3/02 16/273
4,353,146 A * 10/1982 Brockhaus ..... E05D 5/14 16/273
4,713,861 A * 12/1987 Bancroft ..... E05D 5/125 16/222
4,964,193 A 10/1990 Rommelfaenger
6,173,475 B1 * 1/2001 Senn ..... E05D 5/14 16/273
6,718,595 B1 4/2004 Berger
8,191,205 B2 * 6/2012 Forrest ..... E05D 5/14 16/273

FOREIGN PATENT DOCUMENTS

FR 2623553 A1 * 5/1989 ..... E05D 5/12

* cited by examiner

*Primary Examiner* — William Miller
(74) *Attorney, Agent, or Firm* — Jesus Sanchelima, Esq.; Christian Sanchelima, Esq.

(57) ABSTRACT

A hinge assembly for garage doors having two leaf assemblies and a central tubular supporting member. A sleeve member is coaxially mounted within the supporting member and in turn it coaxially houses a roller shaft extending beyond the supporting member. The shaft has a roller mounted at one end. A push nut fastener mounted to the shaft member and the sleeve member abuttingly mounted to one end of the inner sleeve member. The leaf assemblies' movement is constrained along the tubular supporting member. The sleeve is made of a self-lubricating plastic material.

4 Claims, 8 Drawing Sheets

HINGE ASSEMBLY WITH SELF LUBRICATED PIN WITH ROLLER ASSEMBLY

BACKGROUND OF THE INVENTION

1. Field of the Invention

The present invention relates to a hinge assembly, and more particularly, to a hinge with self-lubricated rotably mounted sleeve with a sleeved roller assembly.

2. Description of the Related Art

Many designs for hinge assembly have been designed in the past. None of them, however, include a self-lubricated sleeve that facilitates the movement of the hinge leaves with reduced levels of noise and uniformly restricted movement of the hinge leaf assemblies. The roller assemblies have the same problems. The present invention solves the noise problem and also keeps the push nut fasteners at predetermined distance consistently. This avoids irregular and forceful lateral movements of the rollers within the hinge assembly.

Applicant believes that the closest reference corresponds to U.S. Pat. No. 4,964,193 issued to Rommelfaenger et al. on Oct. 23, 1990 for a hinge including two leaves with interengaging knuckles. The Rommelfaenger's patented hinge has a plastic coated metal hinge pin that extends through the knuckles and the knuckles are crimped onto the plastic coated hinge pin. In the Rommelfaenger's patent, the tighter the knuckles grip the pin, the greater will be the torque required to operate the hinge. However, it differs from the present invention because the Rommelfaenger's patented invention includes a plastic coating intended to provide more friction while the present invention includes a plastic self-lubricated rotably mounted sleeve intended to provide practically no friction and substantially noiseless. The more lax specifications of some hinges (garage door hinges) do not require a tight engagement of the central pin and the knuckles.

Applicant believes that another related reference corresponds to French patent No. 2,623,553 issued to Boismain on May 26, 1989 for a hinge with lateral engagement for a leaf and the like. Boismain's patented hinge includes a strip (33) made of self-lubricating material intended for easily engaging and removing the leaves by a horizontal movement. However, the disposition of the loop (21) against shoulder (7) causes metal friction and therefore noisy movement of the hinge.

Lastly, another related reference is Allen Berger's U.S. Pat. No. 6,718,595 for a hinge assembly with self-lubricated pin. However, this patent also fails to disclose the use of a self-lubricated sleeve positioned between the supporting members at the roller shaft and with a predetermined length that cooperatively acts as a stopper to keep a push nut fastener at the same length as with other roller assemblies on the same door installation.

For garage door applications there is no need for tight tolerances for the knuckles, which makes them more expensive. It is nevertheless desirable to have a noiseless hinge, even for garage doors.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a hinge assembly with plastic self-lubricated sleeve intended to reduce hinge friction of the leaves with the roller shaft.

It is another object of this invention to provide a hinge assembly with plastic self-lubricated sleeves rotably mounted over a central supporting member to facilitate a noiseless movement and simultaneously act as a stopper guide for readily positioning push nut fasteners in an alignment arrangement with each other in a door installation.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
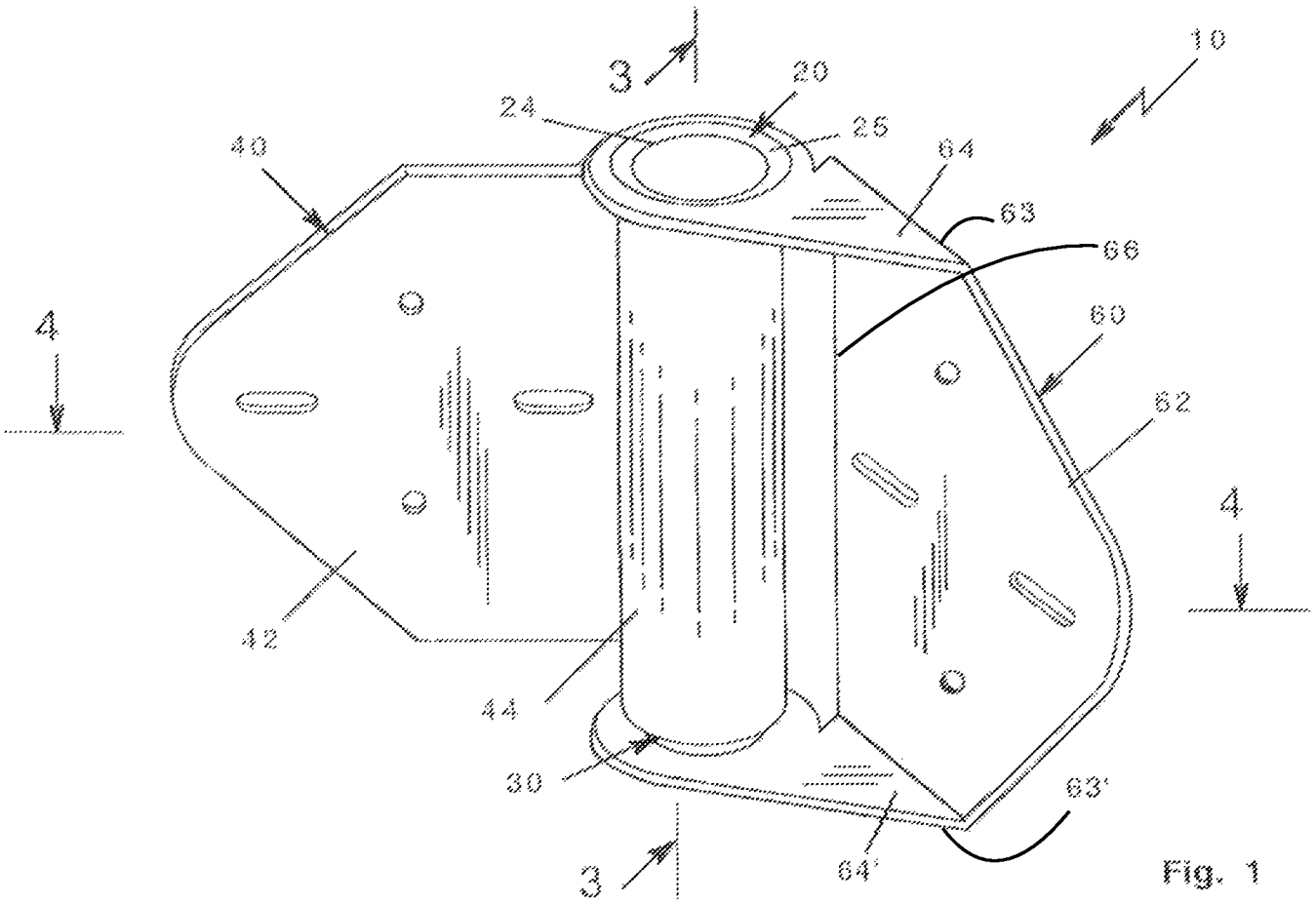
FIG. 1 represents an isometric view of the hinge assembly object of the present invention.
Figure 1A:
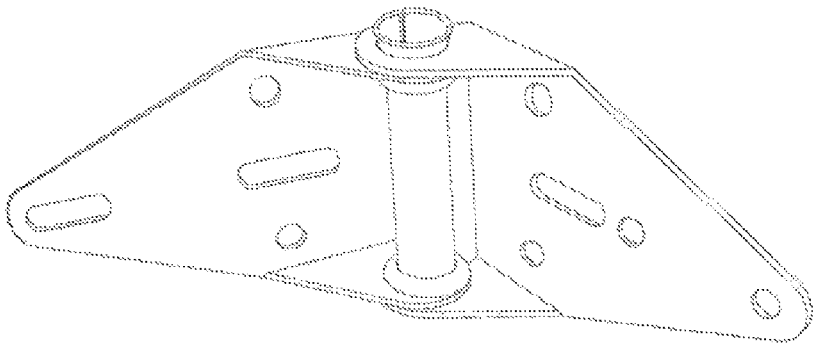
PRIOR ART FIG. 1A
FIG. 1A represents an isometric view a prior art hinge assembly.

Referring now to the drawings, where the present invention is generally referred to with numeral 10, it can be observed that it basically includes supporting member 20 and leaf assemblies 40 and 60 in one of the embodiments. Embodiment 10 utilizes a hinge assembly that includes sleeve 30 as disclosed in Berger's U.S. Pat. No. 6,718,595. An alternate embodiment 110 is shown using a conventional prior art hinge assembly, such as the one represented in FIGS. 1A and 2A. Alternate embodiment 110 can be best seen in FIGS. 3A and 4A.

The present invention, in one of its applications, allows an installer of garage doors with articulated panels to align the positioning of push nut fasteners with each other. This provides a uniform predetermined travel for the hinge leaf assemblies. This travel is pre-selected to avoid unnecessary strain and fatigue as the articulated panels move along a track coupled to the roller members.

Figure 2:
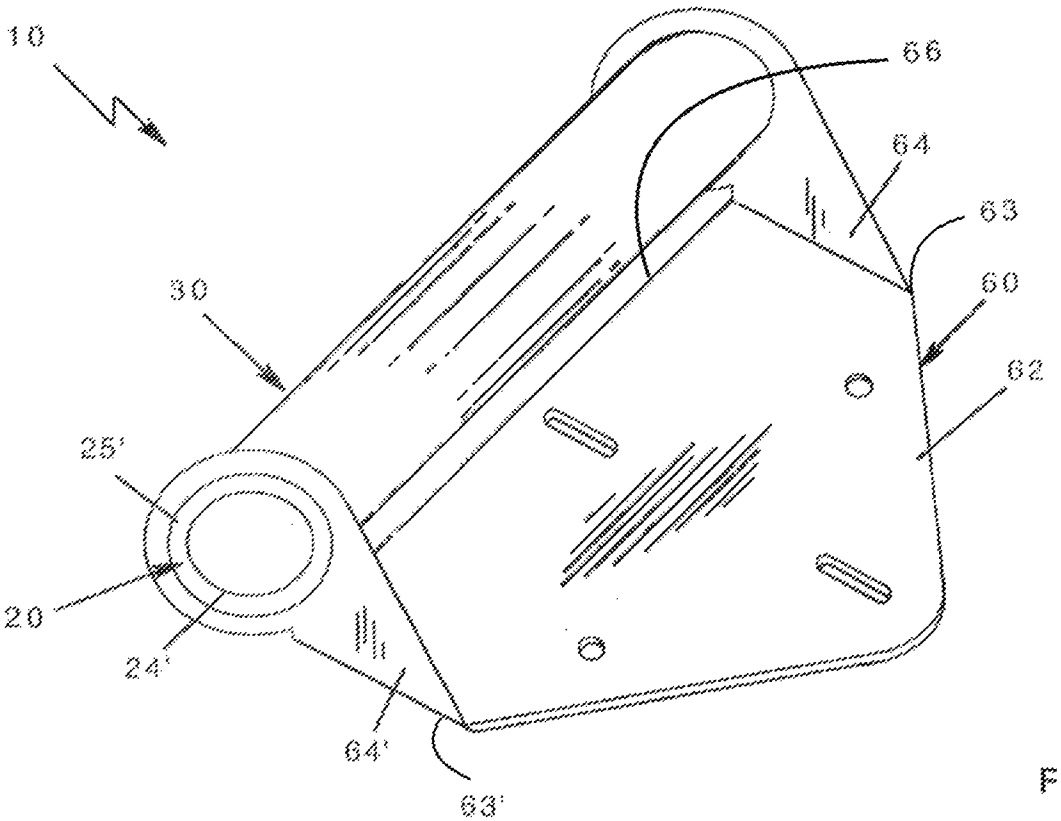
FIG. 2 is an isometric view of the supporting member and one of the leaf assemblies, showing the ends of the former rigidly mounted to the angular walls of the leaf assembly.
Figure 2A:
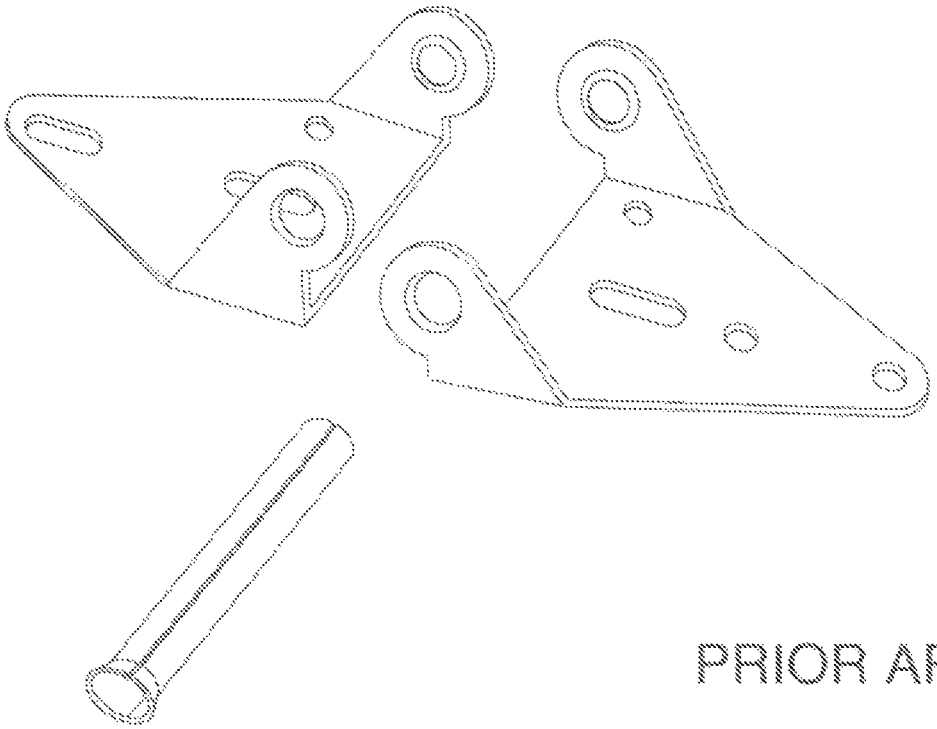
PRIOR ART FIG. 2A
FIG. 2A is an exploded isometric view of the prior art hinge assembly shown in FIG. 1A.

Central supporting member 20 is made out of a rigid material, and in one of the preferred embodiments, it is a tubular member with upper and lower ends 24 and 24', respectively. Ends 24 and 24' include outwardly extending flanges 25 and 25', in the preferred embodiment, that are rigidly mounted to angular walls 64 and 64' by welded joints 21 in one of the preferred embodiments. Walls 64 and 64' are rigidly and perpendicularly mounted to leaf member 62 of leaf assembly 60 at ends 63 and 63' respectively, as best seen in FIG. 2. Sleeve member 30 journals central portion 22 of supporting member 20 between angular walls 64 and 64'.

Sleeve member 30 is rotably mounted over central portion 22. Sleeve member 30 is made out of a plastic self-lubricating polymer material, such as Delrin or equivalent. Delrin is a trademark of E.I. Dupont Nemoms & Co., 1007 Market St., Wilmington, Del., U.S.A.

Figure 3:
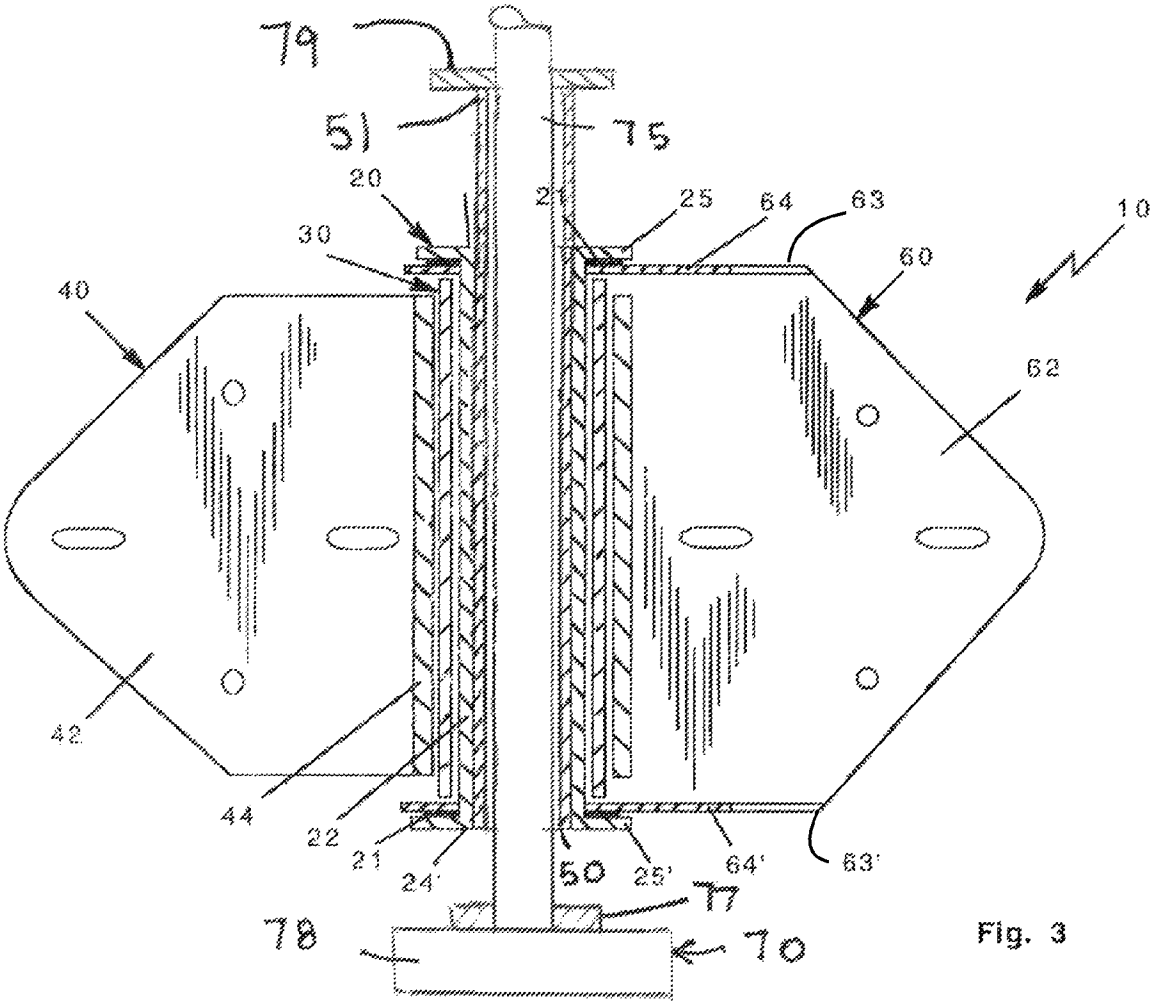
FIG. 3 shows a front elevational view of the invention partially cross-sectioned to show the central tubular member.

An inner sleeve 50, as seen in FIG. 3, self-lubricated like sleeve 30, is coaxially mounted within member 20 terminating with end 51. Sleeve 50 coaxially receives roller shaft 75 of roller assembly 70. Roller shaft 75 is provided with rotably mounted roller 78 at one of its ends.

Leaf assembly 40 includes leaf member 42 and folded portion 44. Folded portion 44 is rotatably mounted over sleeve member 30. Folded portion 44 covers member 30 entirely. The clearances between folded portion 44, member 30 and central tubular member 22 are not tight, but rather slightly loose to avoid frictional forces as much as possible.

Leaf assembly 60 includes leaf member 62, ends 63 and 63', angular walls 64 and 64' and elongated edge 66. Edge 66 limits the movement of leaf assembly 60 so that in the open extreme position, leaf assemblies 40 and 60 are disposed at 180-degree angle. Additionally, the disposition of edge 66 is to avoid pinching a user by the hinge.

Figure 4:
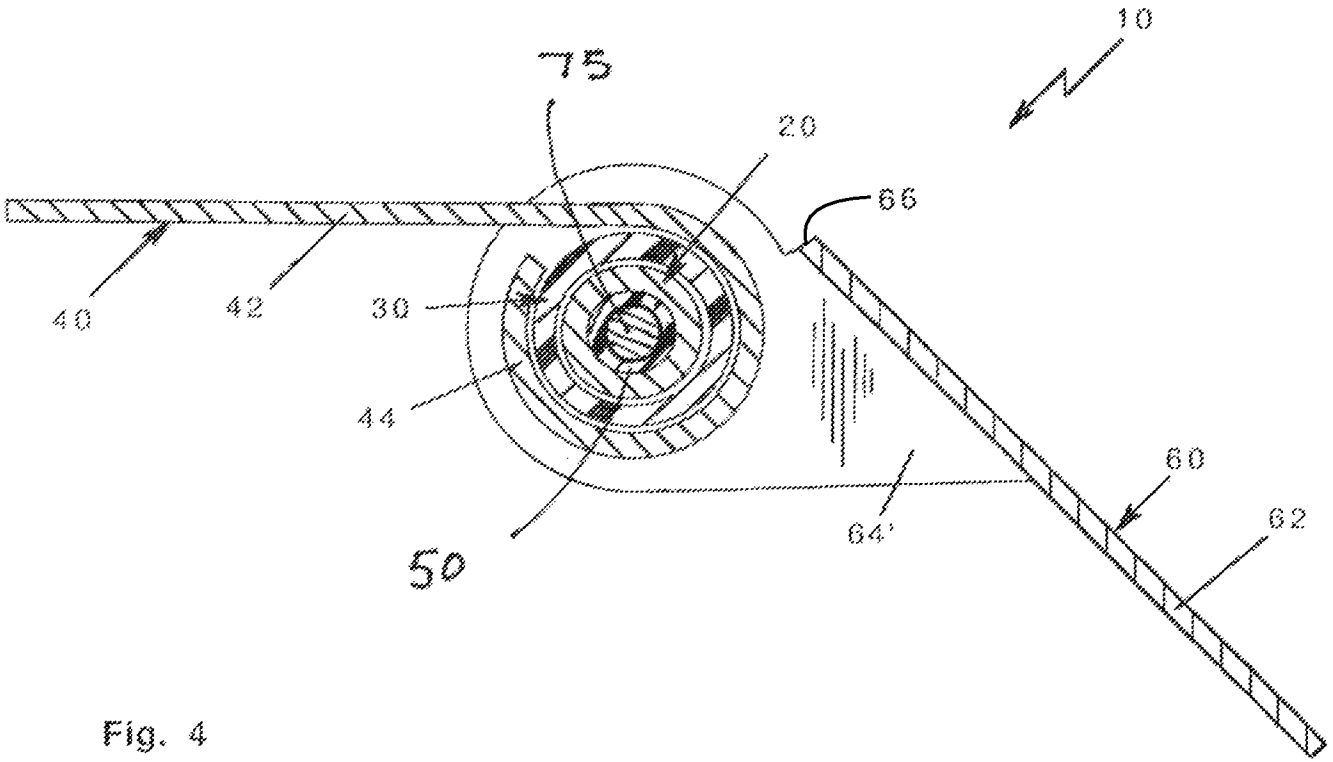
FIG. 4 illustrates a cross-sectional view of the invention taken along line 4-4 in FIG. 1.

As best seen in FIGS. 3 and 4 roller assembly 70 includes shaft 75 and roller member 78 rotably mounted at one end with a stop separator 77 to keep the inner face of roller member 78 at a spaced apart distance from flange 25. The stop separator 77 can be implemented with a cylindrical extension, in one of the preferred embodiments. Any other type of separators can also be used. The other end is free except for the mounting of push nut fastener 79 at a predetermined location. At present, the positioning of fastener 79 is estimated by the installer and many times is not in alignment with other fasteners 79 in the same door installation. By selecting sleeves 50 having a predetermined length one of its ends acts as a stopper to keep fasteners 79 in the same position relative to flange 25. Then, the maximum travel distance of leaf assemblies 40 and 60 is limited by the uniform and aligned positioning of push nut fasteners 79.

Figure 3A:
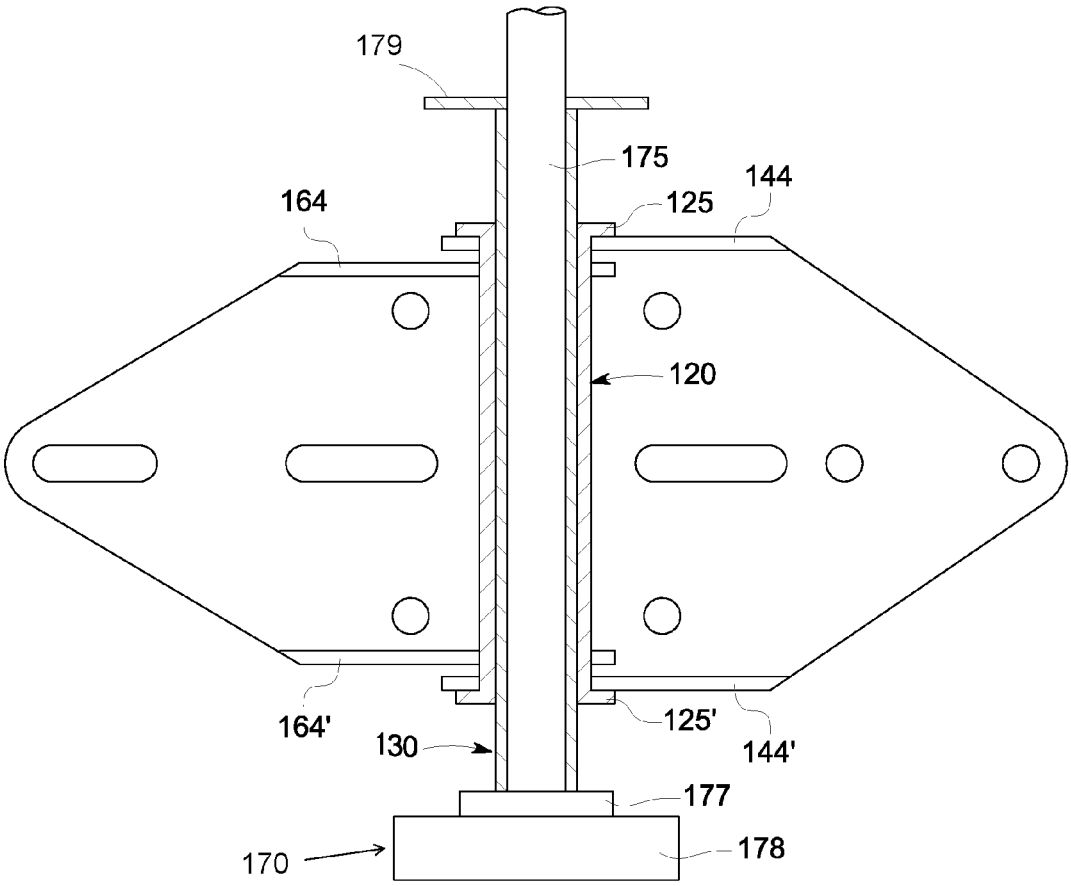
FIG. 3A is similar to FIG. 3 except that the hinge assembly used is the prior art hinge showed in FIGS. 1A and 2A.
Figure 4A:
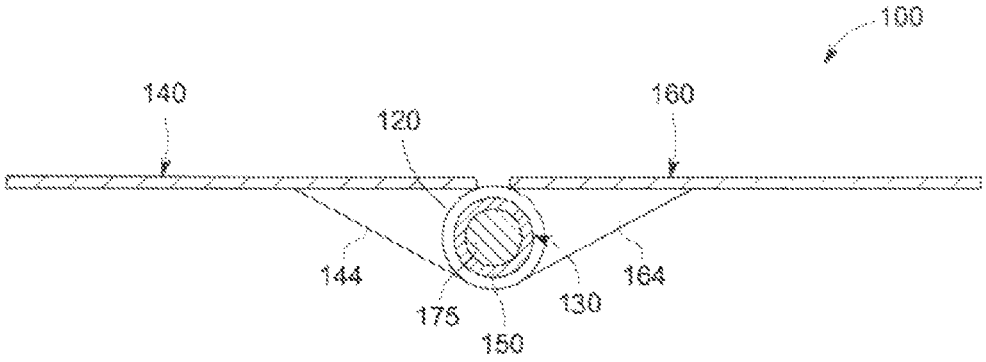
FIG. 4A illustrates a cross-sectional similar to the one shown in FIG. 4, except that the prior art hinge assembly shown in FIGS. 1A and 2A is used.

In an alternate embodiment 100 (components are similar to the first embodiment's numbers) shown in FIGS. 3A and 4A, inner sleeve 130 is mounted to a central support member 120 of a prior art hinge assembly. Member 120 includes outwardly extending flanges 125; 125'. As with the other embodiment, sleeve 130 has a predetermined length that permits their alignment in a given door installation. Simultaneously, sleeve 130 reduces the metal to metal clanking noise. Inner sleeve 150 is self-lubricated and is coaxially mounted within member 120. Leaf assembly 140 includes angular walls 144; 144' and leaf member 160 includes angular walls 164; 164'. Roller assembly 170 includes shaft 175 and roller assembly 178 rotably mounted at one end and fastener 179 at the other end. A spacer 177 is mounted to shaft 175 adjacent to roller assembly 178.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A hinge and roller assembly comprising:

A) a first leaf assembly having a first flat portion with first and second ends, and including first and second angular walls perpendicularly mounted to said first and second ends, respectively;

B) a tubular supporting member having a first predetermined length being rigidly mounted between said first and second angular walls;

C) a second leaf assembly having a second flat portion with third and fourth angular walls journaling said tubular supporting member so that said second leaf assembly rotates about said tubular supporting member;

D) a sleeve of a second predetermined length longer than said first predetermined length and having first and second ends and said sleeve being coaxially mounted within said tubular supporting member; and E) a roller shaft assembly including a shaft member of a third predetermined length longer than said second predetermined length and coaxially received within said sleeve and said shaft member having first and second ends, said first end of said shaft member having a roller member rotably mounted thereon and said roller assembly further including a push nut fastener mounted to said shaft member and positioned abuttingly against said first end of the sleeve.

2. The hinge assembly set forth in claim 1 wherein said sleeve member is made out of a plastic self-lubricating material.

3. A hinge and roller assembly comprising:

A) a first leaf assembly having a first flat portion with first and second ends, and including first and second angular walls perpendicularly mounted to said first and second ends, respectively;

B) a tubular supporting member rigidly mounted between said first and second angular walls;

C) a first sleeve rotably mounted over said supporting member;

D) a second leaf assembly having a second flat portion and a folded portion journaling said sleeve so that said second leaf assembly rotates about said sleeve and supporting member;

E) a second sleeve having first and second end and being coaxially mounted within said tubular supporting member; and F) a roller shaft assembly including a shaft member coaxially received within said second sleeve and said shaft member having first and second ends, said first end of said shaft member having a roller member rotably mounted thereon and said roller assembly further including a push nut fastener mounted to said shaft member and positioned abuttingly against said first end of the second sleeve.

4. The hinge assembly set forth in claim 3 wherein said second sleeve member is made out of a plastic self-lubricating material.

* * * * *